US006186747B1

(12) United States Patent
Zhou et al.

(10) Patent No.: US 6,186,747 B1
(45) Date of Patent: Feb. 13, 2001

(54) AXIAL PLUNGER SLURRY PUMP

(76) Inventors: Haiwei Zhou, No. 14, Buliding 19, Li 1, Zhu Jiafen, Fengtai District, Beijing, 100072 (CN); Xuming Yin, No. 4, Unit 2, Building 20, Driling Company Jian He Bridge, Guan Zhuang Town, Nanyang City, Henan Province 473132 (CN)

( * ) Notice: Under 35 U.S.C. 154(b), the term of this patent shall be extended for 0 days.

(21) Appl. No.: 09/194,887

(22) PCT Filed: Jun. 6, 1997

(86) PCT No.: PCT/CN97/00057

§ 371 Date: Jul. 6, 1999

§ 102(e) Date: Jul. 6, 1999

(87) PCT Pub. No.: WO97/46804

PCT Pub. Date: Dec. 11, 1997

(30) Foreign Application Priority Data

Jun. 6, 1997 (CN) ..... 96106355

(51) Int. Cl.[7] ..... F04B 1/12

(52) U.S. Cl. ..... 417/269; 417/569; 264/159; 92/165; 92/57; 92/251; 91/375; 91/485; 91/488; 91/489; 91/499; 91/505; 91/506; 74/60; 222/321.19

(58) Field of Search ..... 417/269, 569; 92/57, 165, 251; 91/375, 485, 488, 489, 499, 505, 506; 74/60; 222/321.9; 264/159

(56) References Cited

U.S. PATENT DOCUMENTS

| | | | | |
|---|---|---|---|---|
| Re. 29,519 | * | 1/1978 | Scott et al. | 91/499 |
| 3,211,346 | * | 10/1965 | Meshberg | 222/321.9 |
| 3,739,692 | * | 6/1973 | Bell | 91/506 |
| 3,817,663 | * | 6/1974 | Zehner | 417/569 |
| 3,827,337 | * | 8/1974 | Pruvot | 91/489 |
| 3,866,518 | * | 2/1975 | Miyao et al. | 91/488 |
| 3,866,519 | * | 2/1975 | Miyao et al. | 417/488 |
| 4,142,450 | * | 3/1979 | Thoma | 91/485 |
| 4,220,072 | * | 9/1980 | Numazawa et al. | 91/375 |
| 4,379,112 | * | 4/1983 | Heikes, Jr. et al. | 264/159 |
| 4,617,853 | * | 10/1986 | Wagenseil et al. | 91/505 |
| 4,735,129 | * | 4/1988 | Sjoberg | 92/251 |
| 5,061,155 | * | 10/1991 | Masaoka et al. | 417/269 |
| 5,249,506 | * | 10/1993 | Willimczik | 91/499 |
| 5,450,782 | * | 9/1995 | Hart et al. | 92/165 |
| 5,752,413 | * | 5/1998 | Kuhn et al. | 74/60 |
| 5,755,562 | * | 5/1998 | Novacek et al. | 417/269 |
| 5,931,644 | * | 8/1999 | Glassey et al. | 417/269 |
| 6,000,316 | * | 12/1999 | Moller et al. | 92/57 |

* cited by examiner

*Primary Examiner*—Timothy S. Thorpe
*Assistant Examiner*—Steven Brown
(74) *Attorney, Agent, or Firm*—Laff, Whitesel & Saret, Ltd.; J. Warren Whitesel

(57) ABSTRACT

An axial plunger slurry pump comprises a pump body, a sloping cam plate, a swashplate, cylinders, plungers and a pump head. Each of the plungers comprises a plunger body with a rubber piston positioned in its front end and being able to slide over it, and an oil receiving gap communicating with an oil passage disposed between two facing end surfaces of the plunger body and the rubber piston. There are check valves each of which is provided in an oil passage between a ball of each of two-ball links, which ball is coupled with the swashplate, and the swashplate. Each of the cylinder and the plunger body are fitted together by means of a half-and-half locating pad, a cylinder sleeve, a pressing cap, and a locking device. The pump may be used widely in drilling, electric power, mine, building, and metallurgy, etc., for conveying mud, mortar, ore pulp, coal pulp, concrete, etc.

12 Claims, 3 Drawing Sheets

AXIAL PLUNGER SLURRY PUMP

FIELD OF THE INVENTION

The invention relates to a pump adapted for conveying heterogeneous fluids or viscous fluids.

BACKGROUND OF THE INVENTION

Until recently, a three-cylinder piston pump driven by a crank link mechanism is commonly used in oil drillings. This pump may generate a high pressure of 20–25 Mpa as well as a flow rate up to 40 l/sec and is widely used in processes of high pressure jet-drillings, near-equilibrium drillings and directional group drillings, but it is complex in structure, heavy in weight, and difficult in transportation. In addition, the cylinders and pistons of the pump are easily worn and such a pump has a short service life, inefficiency, inconvenience in assembling and disassembling, and a non-uniform output flow. Moreover, the clearance between transmission members, such as a crank and a link, may be increased as the service time is extended and the wear of the members becomes intensified, which will aggravate the impact of movement and add the non-uniformity of the flow. This non-uniformity will cause transfer lines to jump in a drilling process, which gives an impact to well walls and is associated with stronger noises. The Chinese Utility Model No. 85203981 entitled "Slurry Pump for Oil Drilling" proposed a seven-cylinder rotary plunger pump with a plunger moved in a cylinder by a swashplate and a sloping cam plate. In comparison with the aforementioned three-cylinder plunger pump, the seven-cylinder rotary plunger pump has a smaller volume, a light weight, a uniform output flow, and a higher pressure; however, it also suffers from the easily worn plunger and cylinders, a short service life, inconvenience in maintenance, and a violent impact of movement, etc.

SUMMARY OF THE INVENTION

The primary object of the invention is to provide an axial plunger slurry pump having a small volume, a light weight, a uniform output flow, a high efficiency, and a long service life to overcome the disadvantages of the known slurry pumps.

An another object of the invention is to provide an axial plunger slurry pump which has further advantages in convenient assembling and disassembling and easy maintenance.

A further object of the invention is to provide an axial plunger type slurry pump which may automatically compensate the wear clearance between a ball and a ball socket of a ball and socket joint, thereby decreasing the impact of movement and the noise.

A yet another object of the invention is to provide an axial plunger slurry pump which has further a pump valve of a long service life and a reliable seal.

According to the present invention, there is provided an axial plunger slurry pump comprising: a pump body, a sloping cam plate located in the pump body and driven by a drive shaft, a swashplate supported on the drive shaft through a ball and socket joint and swinging as the sloping cam plate rotates, at least seven plungers, each of which is coupled with the swashplate by means of a ball of one of two-ball links and moves reciprocally in a cylinder as the swashplate swings, and a pump head with a pump valve, wherein each of the plunger comprises a plunger body with a rubber piston positioned in its front end and being able to slide over it, and an oil receiving gap communicating with an oil passage disposed between two facing end surfaces of the plunger body and the rubber piston, and wherein there are check valves to keep the oil from reflowing, each of which is provided in an oil passage between a ball of each of two-ball links, which ball is coupled with the swashplate, and the swashplate.

The cylinder and the plunger of the axial plunger slurry pump according to the invention are preferably fitted together by means of a half-and-half locating pad, a cylinder sleeve, a pressing cap, and a locking device which are successively connected with the pump body.

In the axial plunger slurry pump according to the invention, a ball of the ball and socket joint and a support shaft are preferably connected with each other in such a manner that they may slide relative to each other along an axial direction, and the ball is always biased against a ball socket in the swashplate by a bias device.

In an aspect of the invention, the pump valve is preferably provided with a conical valve core which has oblique straight blades at its lower end and is fitted with a valve seat.

More preferably, there are a plurality of reinforcing support stays evenly and circumferentially distributed between the pump body and the pump head.

In the axial plunger slurry pump according to the invention, there is at the front end of the plunger body the rubber which may slide over it, there is the oil receiving gap between the two facing end surfaces of the plunger body and the rubber piston, and there is a check valve to keep the oil from reflowing in each oil passage between a ball of a two-ball link, which ball is coupled with the swashplate, and the swashplate. As a result, in the operation of the pump, during the compression stroke, firstly, there is an equilibrium between an inner pressure in the oil receiving gap and an output pressure because the oil has been sealed in the oil receiving gap, so that the two sides of the rubber piston are in a static pressure equilibrium state, thereby improving the operation conditions of it and causing it to serve the only function of separating slurry. Moreover, because the rubber piston is in equilibrium, dirty materials in the pumped slurry are difficult to wedge into the interface of the rubber piston and the cylinder thereby reducing the wear of the rubber piston and the cylinder. Secondly, because an oil pressure at the ball of the two-ball link, which ball is coupled with the swashplate, is in equilibrium with an oil pressure at the plunger body, the two-ball link is also in a static pressure equilibrium sate, thereby improving the force receiving conditions of an plunger assembly and prolonging the service life thereof.

Moreover, in the axial plunger slurry pump according to the invention, each of the cylinders and the pump body are fitted together by means of the half-and-half locating pad, the cylinder sleeve, the pressing cap, and the locking device which are successively connected with the pump body; therefore, when the rubber piston or the cylinder are worn out, only by unscrewing the pressing cap, pulling out the half-and-half locating pad from two sides, and then withdrawing the plunger assembly into the pump body, one can remove the cylinder laterally to repair it or the plunger. Thus, the maintenance and assembling-disassembling can be easily carried out.

Furthermore, in the axial plunger slurry pump according to the invention, because the ball of the ball and socket joint and the support shaft are so designed that they may slide relative to each other, and that the ball is biased against the ball socket in the swashplate by the bias device provided between the ball and a pump cover, it is possible to compensate automatically the wear clearance between the ball and the ball socket and to decrease the impact of movement. Thus the pump may operate more smoothly with a lower noise.

In the axial plunger slurry pump according to the invention, there are provided with oblique straight blades at the lower end of the valve core of the pump valve. Thus, in operation, the liquid flow and the oblique blades interact so that the blades rotate thereby rotating the valve core. In this way, the quantity of particle materials remaining on the valve seat decreases significantly, so that a more reliable sealing of the conical surfaces of the valve core and valve seat is realized. Meanwhile, because the rotation of the valve core will pulverize the particles detained on the surfaces of the valve core and the valve seat, the sealing of the conical surfaces is ensured. In addition, the continuous rotating of the valve core may compensate the wear on the contacting portions of the conical surfaces, which will prolong the service life of the pump and further improve the efficiency of the pump.

Moreover, the axial plunger slurry pump according to the invention has a plurality of support bars evenly distributed between the pump body and the pump head; therefore, it is good in integrity as well as in rigidity and may operate steadily.

DETAILED DESCRIPTION OF THE PREFERRED EMBODIMENT

Figure 1:
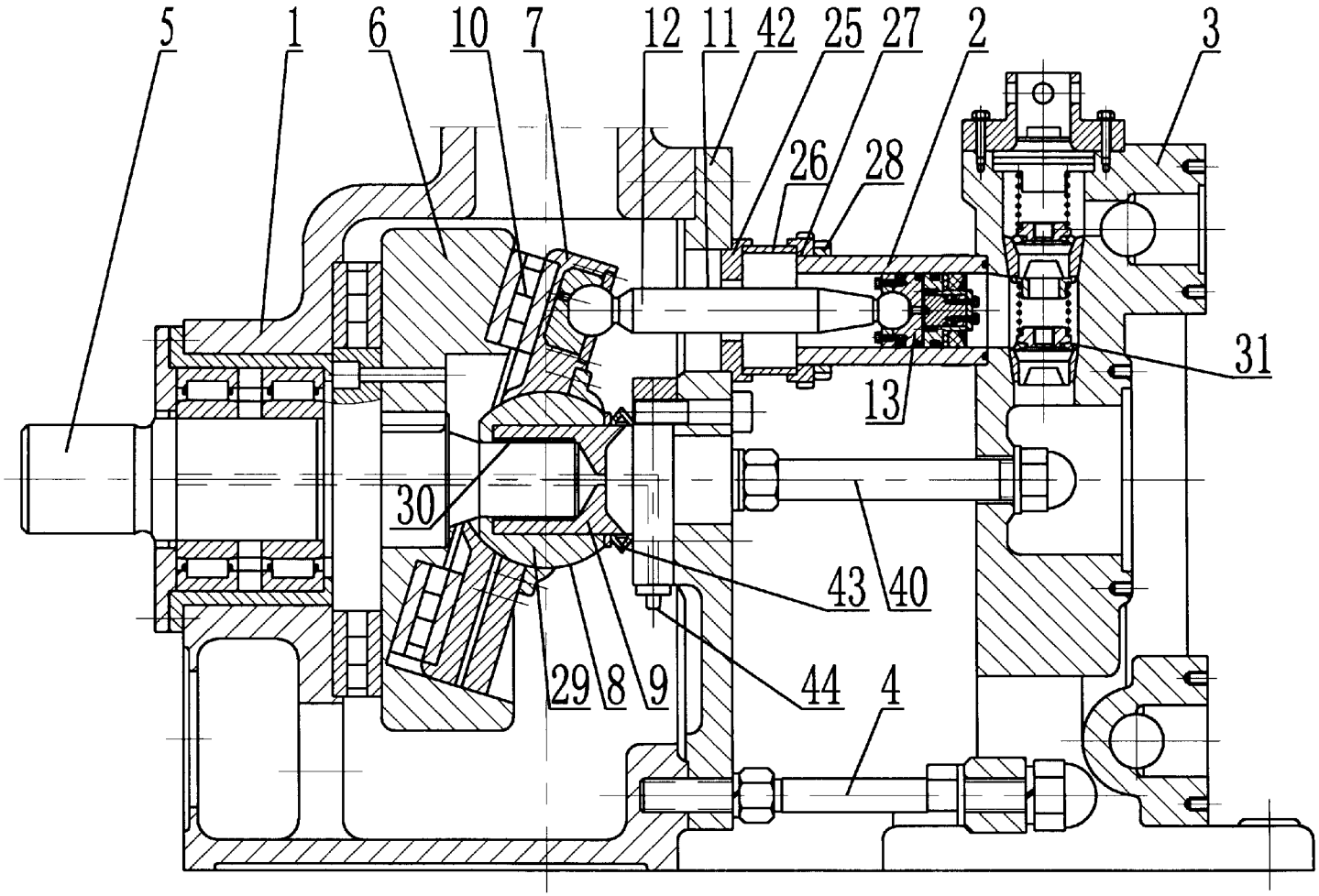
FIG. 1 is a schematic view showing the structure of a first embodiment of an axial plunger slurry pump according to the invention.
Figure 2:
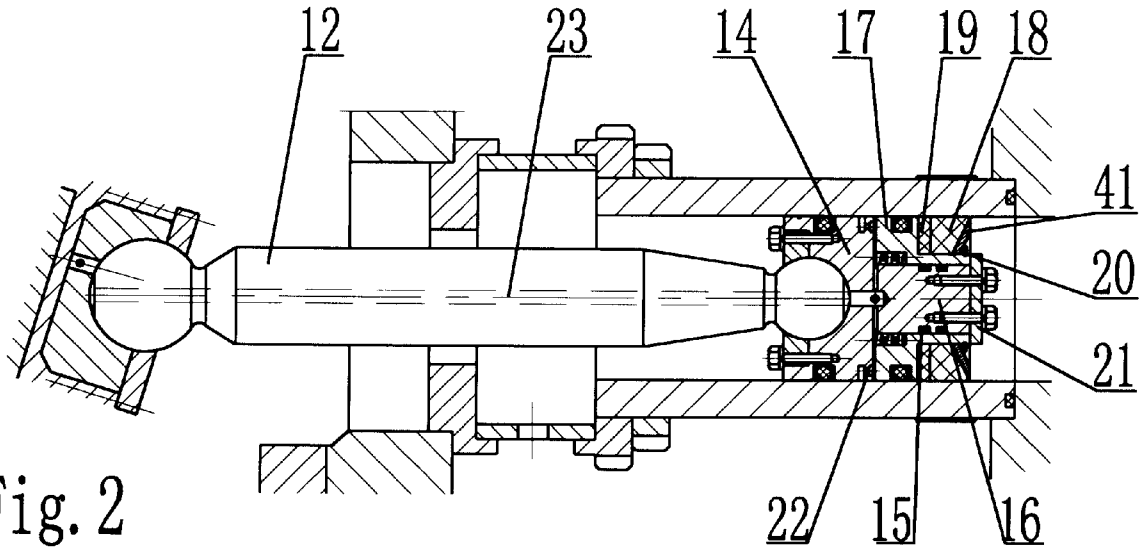
FIG. 2 is an enlarged view of a plunger assembly in the axial plunger slurry pump according to the invention.

Referring now to FIG. 1, in an axial plunger slurry pump according to the invention, a pump body 1, cylinders 2 and a pump head 3 are combined into an integral by means of a plurality of bolts 4 evenly and circumferentially distributed and a central bolt 40. In this embodiment, the number of the cylinders 2 and that of the bolts 4 are each seven. The bolts 4 and the cylinders 2 are arranged to be alternatively spaced. A sloping cam plate 6 driven by a drive shaft 5 is mounted in the pump body 1. A swashplate 7 is supported on a support shaft 9 through a ball joint coupling 8. The swashplate 7 and the sloping cam plate 6 can be connected by means of a thrust bearing 10 in a manner that they may slide relative to each other. A plunger assembly 11 comprises a two-ball link 12 and a plunger 13. The two-ball link 12 has its one end coupled with the swashplate 7 and its other end coupled with the plunger 13. Referring to FIG. 2, the plunger 13 comprises a plunger body 14, a tail end of which is formed as a small shaft 16 with annular grooves 15. A piston sleeve 17 is provided on the small shaft 16, and a rubber piston 18 is disposed on the piston sleeve 17. A plastic support ring 19 is disposed between the rubber piston 18 and the piston sleeve 17. A retaining ring 41 is mounted on the outer surface of the rubber piston 18 and is retained by a snap ring 20 which is clamped on the piston sleeve 17. The outer surface of the piston sleeve 17 is retained by a barrier 21, thereby keeping the sleeve from slipping off the small shaft 16 of the piston body 14. Obviously, it is possible to mount the rubber piston 18 directly on the small shaft 16 of the piston body 14 without the piston sleeve 17, the plastic support ring 19 or the retaining ring 41. An oil receiving gap 22 is arranged between two facing end surfaces of the plunger body 14 and the piston sleeve 17. The oil receiving gap 22 communicates with an oil passage in the piston body 14 and an oil passage 23 in the two-ball link 12. There are check valves 24 with each of them being provided in an oil passage between a ball of the two-ball link 12, which ball is coupled with the swashplate 7, and the swashplate 7.

Referring back to FIG. 1, in the axial plunger slurry pump, each of the cylinders 2 and the pump body 1 are connected by means of a half-andhalf locating pad 25, a cylinder sleeve 26 and a pressing cap 27. The inner diameter of the cylinder sleeve 26 is slightly larger than the outer diameter of the cylinder 2. The pressing cap 27 is in a threaded connection with the cylinder 2, and the pressing cap 27 is locked by means of a nut 28. A ball 29 of the ball and socket joint 8 and the support shaft 9 are assembled together in such a way that they can slide relative to each other. A disk spring 43 is mounted on the support shaft 9 between the ball 29 and a pump cover 42 of the pump body 1. The disk spring 43 biases the ball 29 against a ball socket of the ball and socket joint 8 in the sloping cam plate 7, thereby compensating automatically the wear of the ball 29 and the ball socket, decreasing the impact of movement and the noise originated from the impact, and causing the pump to operate more smoothly. Obviously, the disk spring 43 may be substituted by other devices that can possess the bias function, such as a pressure spring or a hydraulic drive piston. A sliding bearing 30 is disposed between the drive shaft 5 and the support shaft 9.

Figure 3:
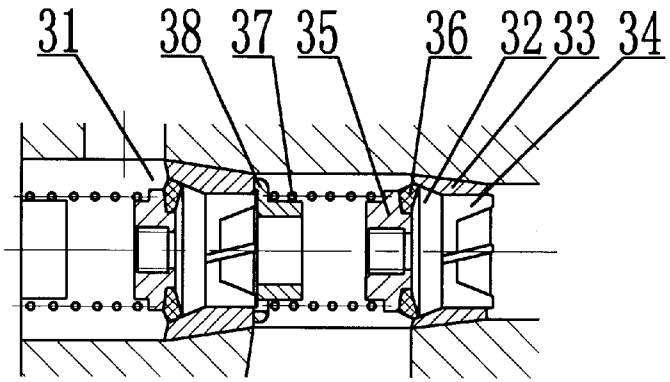
FIG. 3 is an enlarged view showing the structure of the pump valve in the axial plunger slurry pump according to the invention.

Referring to FIG. 3, there are shown schematically the structure of a pump valve (input/output valve) 31 adapted in the axial plunger slurry pump according to the invention. A valve core 32 and a valve seat 33 of the pump valves 31 are each made of metal, and two matching surfaces of the valve core 32 and the valve seat 33 are hard conical surfaces. There are provided at the lower portion of the valve core 32 at least three oblique straight blades 34, each of which forms an angle of 8–12° with respect to the axis of the valve core 32. The oblique straight blades 34 act as a guide in cooperation with a hole of the valve seat 33, and drive the valve core 32 to rotate by means of their interaction with the input/output liquid flow during operation. A guide sleeve 35 is mounted on the valve core 32. A rubber seal ring 36 is disposed between the guide sleeve 35 and the valve core 32. A pressure spring 37 mounted on the guide sleeve 35 biases the valve core 32 against the valve seat 33. A spring seat is denoted by 38.

Figure 4:
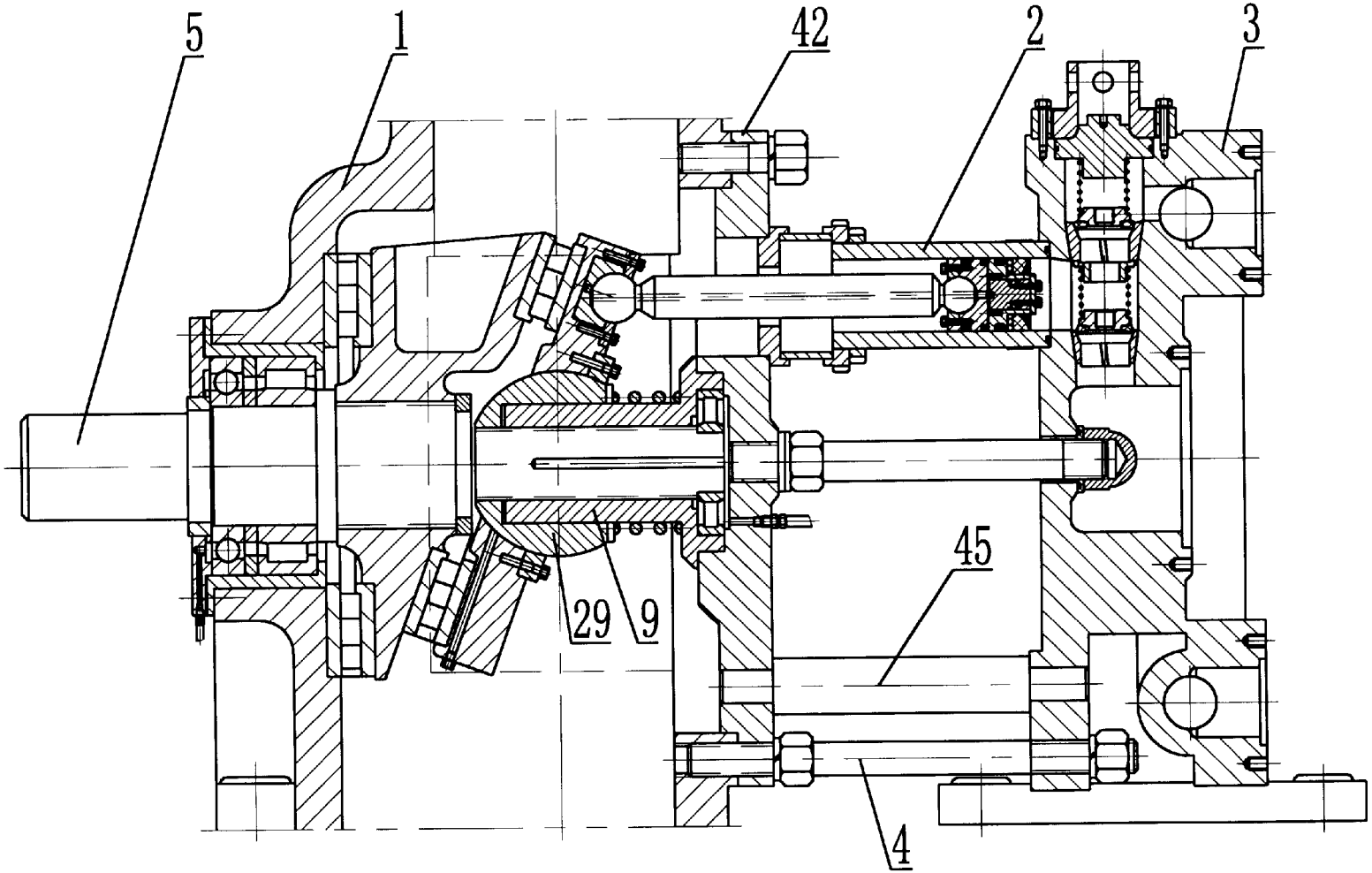
FIG. 4 is a schematic view showing the structure of a second embodiment of the axial plunger slurry pump according to the invention.

Now referring to FIG. 4, there are shown schematically the structure of a second embodiment of the invention. In the second embodiment, there are a plurality of reinforcing support stays 45 evenly and circumferentially distributed between the pump body 1 and the pump head 3. The number of the reinforcing support stays 45, that of the bolts 4 and that of the cylinders 2 are each seven. The reinforcing support stays 45 and the bolts 4 are arranged to be alternatively spaced from the cylinders 2, and the reinforcing support stays 45 are disposed inside relative to the evenly and circumferentially distributed bolts 4. In this embodiment, there are the reinforcing support stay 45 mounted between the pump body 1 and the pump head 3, so that the rigidity of the pump as a whole increases. Therefore, the pump head 3 is hardly swung during an operation of the pump and the pump may work more steadily and more reliably. Moreover, in this embodiment, the inside end of the drive shaft 5 is supported directly on the pump cover 42 through a rolling bearing. The support shaft 9 is mounted on an outer ring of the rolling bearing. In comparison with the first embodiment as shown in FIG. 2, the arrangement in the second embodiment improves the forcing conditions of the drive shaft, thereby causing the pump to work more steadily and more reliably. In addition, a cylindrical pressure spring is used to substitute the disk spring 34 mounted on the support shaft 9 between the ball 29 and the pump cover 42 of the pump body 1 in the first embodiment.

The operation principle of the axial plunger slurry pump is the same as that of conventional hydraulic plunger pumps. During operation, the drive shaft 5 drives the sloping cam plate 6 to rotate. As the sloping cam plate 6 rotates, the swashplate 7 swings back and forth about the center of the ball and socket joint 8, and at the same time drives the plunger assembly 11 to move back and forth. When the plunger 12 moves toward the left in the cylinder 2, the oil from an oil input 44 passes through the check valve 24 and the oil passage 23 in the two-ball link 12 into the oil receiving gap 22 and the slurry is suctioned into the cylinder 2 through a suction valve of the pump valve 31. When the plunger 13 moves toward the right, the slurry in the cylinder 2 is pushed out through an output valve of the pump valve 31. Meanwhile, the pressure of the oil in the oil receiving gap 22 increases under an extrusion of the plunger 14 and the rubber piston 18. Then the check valve 24 is closed and the pressure of the oil in the oil receiving gap 22 is in equilibrium with the output pressure of the slurry, which causes the rubber piston 18 and the two-ball link 12 both operate in a static equilibrium state and improves their operative conditions.

In operation, the ball 29 of the ball and socket joint 8 is always biased against the ball socket of the swashplate 7, resulting in a small impact of movement, a steady operation and a lower noise.

Industry applicability

The axial plunger slurry pump may be widely used in drilling, electric power, mine, building, and metallurgy, etc., for conveying such slurry containing a large quantity of sold particles as mud, mortar, ore pulp, coal pulp, concrete, etc.

What is claimed is:

1. An axial plunger slurry pump comprising:

a pump body, a sloping cam plate located in said pump body and driven by a drive shaft, a swashplate supported on said drive shaft through a ball and socket joint and swinging as said sloping cam plate rotates, at least seven plungers, each of which is coupled with said swashplate by means of a ball of one of two-ball links and moves reciprocally in a cylinder as said swashplate swings, and a pump head with a pump valve, wherein each of said plungers comprises a plunger body with a rubber piston positioned in its front end and being able to slide over said plunger body, an oil receiving gap is provided between said plunger body and the rubber piston for communicating with an oil passage disposed between two facing end surfaces of the plunger body and the rubber piston, and check valves for preventing oil from reflowing are provided in an oil passage between a ball of each of two-ball links, which ball is coupled with said swashplate, and said swashplate.

2. An axial plunger slurry pump according to claim 1, characterized in that a piston sleeve is disposed between said plunger body and said rubber piston, a plastic support ring is disposed between the piston sleeve and the rubber piston, and a retaining ring is mounted on the outer surface of the rubber piston.

3. An axial plunger slurry pump according to one of claim 1 or 2, characterized in each of the cylinders and said plunger body are fitted together by means of a half-and-half locating pad, a cylinder sleeve, a pressing cap, and a locking device which are successively connected with the pump body.

4. An axial plunger slurry pump according to claim 3, characterized in that a ball of the ball and socket joint and a support shaft are connected with each other in such a manner that they may slide relative to each other along an axial direction, and the ball is always biased against a ball socket in said swashplate by a bias device.

5. An axial plunger slurry pump according to claim 4, characterized in that said bias device is a cylindrical pressure spring.

6. An axial plunger slurry pump according to claim 4, characterized in that there are provided with oblique straight blades at a lower end of a valve core of the pump valve, and each of the blades forms an angle of 8–12° with respect to the axis.

7. An axial plunger slurry pump according to one of claim 1 or 2, characterized in that said pump body, said cylinders and said pump head are combined in an integral by means of a plurality of bolts evenly and circumferentially distributed and a central bolt.

8. An axial plunger slurry pump according to claim 6, characterized in that said pump body, said cylinders and said pump head are combined in an integral by means of a plurality of bolts evenly and circumferentially distributed and a central bolt.

9. An axial plunger slurry pump according to claim 7, characterized in that there are a plurality of reinforcing support stays evenly and circumferentially distributed between said pump body and said pump head.

10. An axial plunger slurry pump according to claim 8, characterized in that there are a plurality of reinforcing support stays evenly and circumferentially distributed between said pump body and said pump head.

11. An axial plunger slurry pump according to claim 10, characterized in that the number of the evenly and circumferentially distributed bolts and that of the reinforcing support stays are each seven, the reinforcing support stays and the evenly and circumferentially distributed bolts are arranged to be alternatively spaced from the cylinders, and the reinforcing support stays are disposed inside relative to the evenly and circumferentially distributed bolts.

12. An axial plunger slurry pump according to claim 11, characterized in that an inside end of the drive shaft is supported on a pump cover of the pump body through a rolling bearing.

* * * * *